United States Patent [19]

Wenzel

[11] Patent Number: 4,958,448

[45] Date of Patent: Sep. 25, 1990

[54] SKI BOOT WITH INSERT PIECE

[75] Inventor: Andreas Wenzel, Gamprin, Liechtenstein

[73] Assignee: Fire-Generation Establishment, Gamprin, Liechtenstein

[21] Appl. No.: 306,948

[22] Filed: Feb. 6, 1989

[30] Foreign Application Priority Data

Feb. 12, 1988 [CH] Switzerland ..... 00502/88

[51] Int. Cl.[5] ..... A43B 5/04; A43B 7/14

[52] U.S. Cl. ..... 36/119; 36/93; 36/120

[58] Field of Search ..... 36/117-121, 36/105, 71, 93

[56] References Cited

U.S. PATENT DOCUMENTS

| | | | |
|---|---|---|---|
| 4,454,663 | 6/1984 | Graillat et al. | 36/120 |
| 4,712,315 | 12/1987 | Morell et al. | 36/117 |
| 4,724,625 | 2/1988 | Sartor | 36/117 |
| 4,759,137 | 7/1988 | Lederer | 36/117 |
| 4,835,886 | 6/1989 | Chemello et al. | 36/119 |
| 4,864,743 | 9/1989 | Begey et al. | 36/119 |

FOREIGN PATENT DOCUMENTS

| | | | |
|---|---|---|---|
| 3427612 | 2/1985 | Fed. Rep. of Germany | 36/117 |
| 3527135 | 1/1987 | Fed. Rep. of Germany | 36/119 |
| 3721620 | 1/1988 | Fed. Rep. of Germany | 36/119 |
| 3808652 | 11/1988 | Fed. Rep. of Germany | 36/117 |

*Primary Examiner*—James Kee Chi

*Attorney, Agent, or Firm*—Toren, McGeady & Associates

[57] ABSTRACT

The ski boot comprises a lower shell (1) with which a rear portion (2) of the shaft and a front portion (3) of the shaft are connected so as to be articulated. The lower shell (1) comprises a cut out portion (7) in the rear in the area which is provided for enclosing the lower leg, an insert piece (8) which is arranged at the rear portion (2) of the shaft being insertable in the cut out portion (7). The inclination position of the rear portion (2) of the shaft, and accordingly the inclination position of the entire shaft, can be determined by means of the cooperation of the flanks (*7a*, *8a*) of the cut out portion (7) and the insert piece (8) which extend in the longitudinal direction of the shaft, which inclination position can be varied by means of insert pieces (8) having different radian measures. A clamping device (10, 11) which, in addition to a heel pull (17, 18), is supported at the lower shell (1) serves to fix this inclination position. The ski boot has a great degree of comfort due to the shaft portion (2), which can be swiveled back, and has athletic characteristics due to the shaft which is adjustable with respect to the inclination position and encloses the lower leg of the wearer.

10 Claims, 3 Drawing Sheets

SKI BOOT WITH INSERT PIECE

Ski boot comprising a lower shell which at least encloses the foot and a shaft which encloses the lower leg and comprises a rear portion of the shaft enclosing the back of the lower leg, as well as a front portion of the shaft enclosing the front of the lower leg, wherein the rear portion of the shaft and the front portion of the shaft are connected with the lower shell in an articulated manner, the lower shell and rear portion of the shaft overlap at least partially, and stops for defining the inclination position of the rear portion of the shaft produced by a clamping device are provided at the lower shell and at the rear portion of the shaft.

At present, there is a great demand for ski boots which have athletic movement characteristics on the one hand and offer a large degree of comfort with respect to use, particularly in getting in and out, on the other hand. The two characteristics cannot be combined with presently known ski boots. If one type of boot tends toward a certain direction, disadvantages must be allowed for in the other direction.

From the point of view of getting in and out of the boot, a high degree of comfort is provided particularly by ski boots comprising a shaft which is divided into a rear shaft portion enclosing the back of the lower leg and a front shaft portion enclosing the front of the lower leg, wherein the rear portion of the shaft can be swiveled away to the rear. While the advantages of this type of ski boot consist in the sufficient freedom of movement when getting in and out of them, the ability of the shaft portion to swivel toward the front, which exists either not at all or only to a limited extent, has disadvantageous results. This nonexistent o limited swivelability of the shaft portion toward the front comes about in that the front portion of the shaft must be connected with a rigid lower shell of the ski boot enclosing the foot of the wearer in order to impart a sufficient rigidity to the shaft as a whole. Accordingly, in this type of ski boot, which is designed with less regard to athletic qualities, it is not possible to adapt the swiveling position of the entire shaft while taking into account the movement habits of the wearer.

The other known ski boots which are designed with less regard for comfort, in which the entire shaft can be adjusted within certain inclination positions, have disadvantages with respect to getting in and out of the boots, since the shaft is usually constructed so as to be tubular and can only be spread apart within a defined area for getting in and out of the boot. Particularly at low temperatures, i.e. when the flexibility of the material is relatively low, disadvantages occur when getting in and out of the boot as a result of the insufficient possibility of spreading apart such that it may become a difficult procedure for the wearer.

However, all ski boots of the aforementioned type also have the irksome disadvantage that the instep area of the foot of the wearer is always firmly enclosed by the shaft or the front portion of the shaft, respectively, or by the lower shell. As a result of this enclosing, leverages occur such that the wearer of the ski boot can apply forces along the instep area by means of his lower leg which are so high that they can no longer be proportioned in a directed manner. From the point of view of the wearer, there arises, as a result of these high forces, the disadvantage that the heel is pressed into the back of the lower shell of the ski boot so forcefully that pain may develop or the risk of injuries can even occur. From the point of view of movement characteristics, the high forces lead to a non-proportioned, excessive use of the shovel area of the skis, which impedes directed guidance, and so-called crossing of the skis cannot be prevented, particularly in soft snow conditions.

The invention accordingly has the object of providing a ski boot which is designed for athletic qualities as well as comfort in that it offers the wearer a high degree of comfort during movement on the one hand and when getting in and out of the boot on the other hand, is simple to operate and, in addition, enables a use of the skis which copes with all conditions.

This object is met, according to the invention, in that the lower shell comprises a cut out portion in the area surrounding the lower leg, which cut out portion extends from the upper end along the greater part of the shaft length and is open toward the rear portion of the shaft, an exchangeable insert piece at the rear portion of the shaft being assigned to the cut out portion, wherein the stops are formed by the flanks of the cut out portion and insert piece extending in the longitudinal direction of the shaft.

As is known, per se, a clamping device is also provided in the ski boot, according to the invention, which acts between the lower shell and the rear portion of the shaft so that the rear portion of the shaft can be adjusted in different inclination positions. Such a clamping device preferably comprises an adjusting member and a cable pull, wherein the adjusting member is arranged e.g. at the lower shell and the cable pull produces the connection between the rear portion of the shaft and the adjusting member. The adjusting member can be constructed as a conventionally known clasp which is adjustable so that the different lengths of the cable pull resulting from various inclination positions of the rear portion of the shaft can be compensated for. An adjusting member which is known from other domains and which works according to the principle of a ratchet is also particularly advantageous for the present instance of application. Such an adjusting member can consist of a toothed roller which communicates with an actuating lever, so that the wearer of the ski boot can activate the roller via the actuating lever and thus clamp the cable pull in order to give a determined inclination position to the rear portion of the shaft. The advantage of such an adjusting member consists in that the wearer need not worry about the clamping length of the cable pull, which is dependent on the inclination position of the rear portion of the shaft, and accordingly need not worry about a possible basic adjustment of the adjusting member; rather, the adjusting member need only be actuated until the stops of the lower shell and rear portion of the shaft cooperate sufficiently with one another.

The inclination position of the rear portion of the shaft produced by the aforementioned clamping device is determined by the stops, which are proposed according to the invention, the stops being formed by the flanks of the cut out portion, which extend in the longitudinal direction of the shaft, and by the flanks of the insert piece which likewise extend in the longitudinal direction of the shaft. In order to form these stops, the lower shell is raised relatively far at least in the area of the back of the lower leg, so that the cut out portion has a large longitudinal extension. The rear portion of the shaft has the insert piece at its inside along this longitudinal extension of the cut out portion, so that the insert piece and raised parts of the lower shell complement one another.

The raised parts of the lower shell which enclose at least the back of the lower leg are deformable in an elastic manner in the area where they are penetrated by the cut out portion. Accordingly, there is the possibility that the rear portion of the shaft can be pulled toward the lower shell in every case by means of the clamping device until the flanks of the cut out portion and insert piece extending in the longitudinal direction of the shaft meet one another. A lateral deflection of these elastically deformable parts of the lower shell is not possible, particularly because of the overlapping of the rear portion of the shaft.

The insert piece, which is preferably produced from the same plastics material as the rear portion of the shaft or the remaining parts of the ski boot, advisably has an arc-shaped curve corresponding to the rear portion of the shaft, its apex extending in the longitudinal direction of the shaft being analogous to the rear portion of the shaft, so that the insert piece can be arranged easily inside the rear portion of the shaft. This arrangement is preferably effected by means of detachable connecting means, e.g. in the form of projections at one part and recesses at another part which are dimensioned in such a way that they are self-locking in the manner of a push button connection.

By means of utilizing insert pieces which differ from one another with respect to the magnitude of their radian measure, a shaping path of different magnitudes is made available for the elastically deformable part of the lower shell which is penetrated by the cut out portion, which shaping path is to be overcome until the flanks of the cut out portion and the flanks of the insert piece meet. The elasticity of the portion of the lower shell penetrated by the cut out portion works against the overcoming of this shaping path. If an insert piece is inserted into the cut out portion, this shaping path is overcome, as a rule, by the clamping device so that e.g. the shaping path becomes greater as the radian measure becomes smaller and the inclination position of the rear portion of the shaft is accordingly increased. The absolute inclination position of the shaft, as well as the hardness, can accordingly be varied in order to achieve this inclination position. In extreme cases, there is even the possibility of not inserting an insert piece in the cut out portion at all, which results in an extremely soft shaft.

The variation in magnitude of the radian measure is understood to mean that the radian measure of an individual insert piece can either remain constant, and this constant can change from one insert piece to another, or in that the radian measure at the insert piece can itself change along an insert piece. In the latter case, this results in that the radian measure of an individual insert piece decreases toward the top so that the insert piece assumes the approximate shape of a wedge when viewed from the front. Thus, e.g. a soft shaft and a sharply inclined position of the shaft leads to a more pronounced radian measure which decreases toward the top along the insert piece.

Due to the exchangeability of the insert piece, there exits the possibility of offering the wearer a plurality of insert pieces having different magnitudes with respect to radian measure. Accordingly, it is possible for the wearer himself to adjust the inclination position of the shaft in the same manner as a ski boot which is designed with a view to athletic qualities. The adjustment of the respective inclination position is effected by means of selecting the corresponding insert piece, which can be done in a simple manner without special technical knowledge due to the aforementioned connecting means.

In particular, this manipulation can be effected in a particularly simple manner when the shaft portion is swiveled back corresponding to the position provided for getting in and out of the boot. In making available insert pieces which differ in this way and which can be adapted to movement habits, external conditions and the like e.g. by means of different colors, lettering, numbering and the like, every wearer is afforded the possibility of fashioning a ski boot corresponding to his skiing ability and the respective conditions.

Due to the partitioning of the shaft into a rear and front portion, wherein the rear portion of the shaft can be fixed in various inclination positions with the lower shell accompanied by the cooperation of the clamping device and the flanks of both the cut out portion and the insert piece by means of the step described above, a ski boot is provided which combines the comfort advantages of a boot which can be stepped into from the rear with the athletic advantages of a shaft which is sufficiently adjustable with respect to the inclination position. In order for these advantages to be made use of to a sufficient extent, the front portion of the shaft is preferably constructed as a sleeve which is connected with the lower shell in an articulated manner so as to be swivelable along a supporting part. It is possible to relieve the instep area of the foot by means of such a construction of the front portion of the shaft in that the sleeve only encloses the front of the lower leg of the wearer; accordingly, there is no supporting material of either the front portion of the shaft or the lower shell in the instep area. Accordingly, when the wearer assumes a forward position, the force is not introduced to the skis along the instep area, but, rather, the force is transmitted from the front of the lower leg to the sleeve of the front portion of the shaft and is thus transmitted to the lower shell via the rear portion of the shaft. Accordingly, no painful compressive stresses occur in the foot; rather, only a tensile stress is transmitted to the foot and to the lower leg of the wearer by means of the heel being supported at the lower shell. This substantially more advantageous loading can be controlled by means of arranging the point of articulation between the lower shell and the front and rear portions of the shaft, respectively, wherein the relations are improved the further back the point of articulation is shifted in the lower shell. Accordingly, leverages occur which allow the wearer to transmit the force to the skis in an optimal manner in that the force introduced by means of the forward position acts directly on the rear area of the lower shell via the front portion and rear portion of the shaft, so that this effectively leads to a relieving of the ends of the skis in contrast to the known disadvantageous loading of the tips of the ski in the known ski boots, where this force is transmitted to the skis via the instep area. Moreover, the force can be proportioned in a favorable manner by means of introducing it via the lower leg of the wearer in such a way that a crossing of the skis, primarily in soft snow conditions, can be eliminated. Since the instep area of the ski boot accordingly need no longer fulfill a supporting function, it is sufficient that the ski boot comprise a completely flexible covering in this area, e.g. in the form of an elastic, water-impermeable and sufficiently resistive foil.

The partitioning of the front portion of the shaft into a sleeve and a supporting part connected in an articulated manner with the lower shell also provides the possibility of arranging the sleeve so as to be adjustable with respect to height relative to the supporting part by means of a suitable construction. This adjustable arrangement creates an additional possibility for providing the wearer with a ski boot suited to his movement habits and the respective external conditions. The leverages, and accordingly the application of force, can be varied by adjusting the height of the sleeve. A sufficient cover which is adapted automatically to the vertical position of the sleeve and the inclination position of the supporting part is provided with the aid of the aforementioned, e.g. elastic, foil in the instep area of the ski boot.

In order to fix the sleeve at the supporting part at the respective pre-selected height, it is preferable that fastening means be provided, possibly in connection with an articulation for the swiveling between the sleeve and the supporting part. Such fastening means can consist of screw connections which are easy to use, such as wing nuts and the like, which are arranged at one part and cooperate with the other part in a suitable manner.

In order to connect the front portion of the shaft and the rear portion of the shaft, another embodiment form of the invention is provided corresponding to an adjustable connecting device. Such a connecting device can be constructed as a clasp connection, known per se, which allows a fixing in various positions, so that the clear width of the shaft can be varied accordingly.

In order to ensure a sufficient gripping of the foot of the wearer in the lower shell, it is advisable in addition to provide a heel pull such as is known in the area of boots which can be stepped into from the rear. Such a heel pull acts on the instep area of the foot of the wearer in such a way that it leads to a sufficient grip on the one hand, but still ensures the proportioned application of force described above by means of the front portion of the shaft. Such a heel pull is supported in a suitable manner at the lower shell, wherein a pull part can be clamped in various positions by means of a clasp, known per se.

The invention is explained in more detail in the following by means of the drawings shown by way of example.

Figure 1:
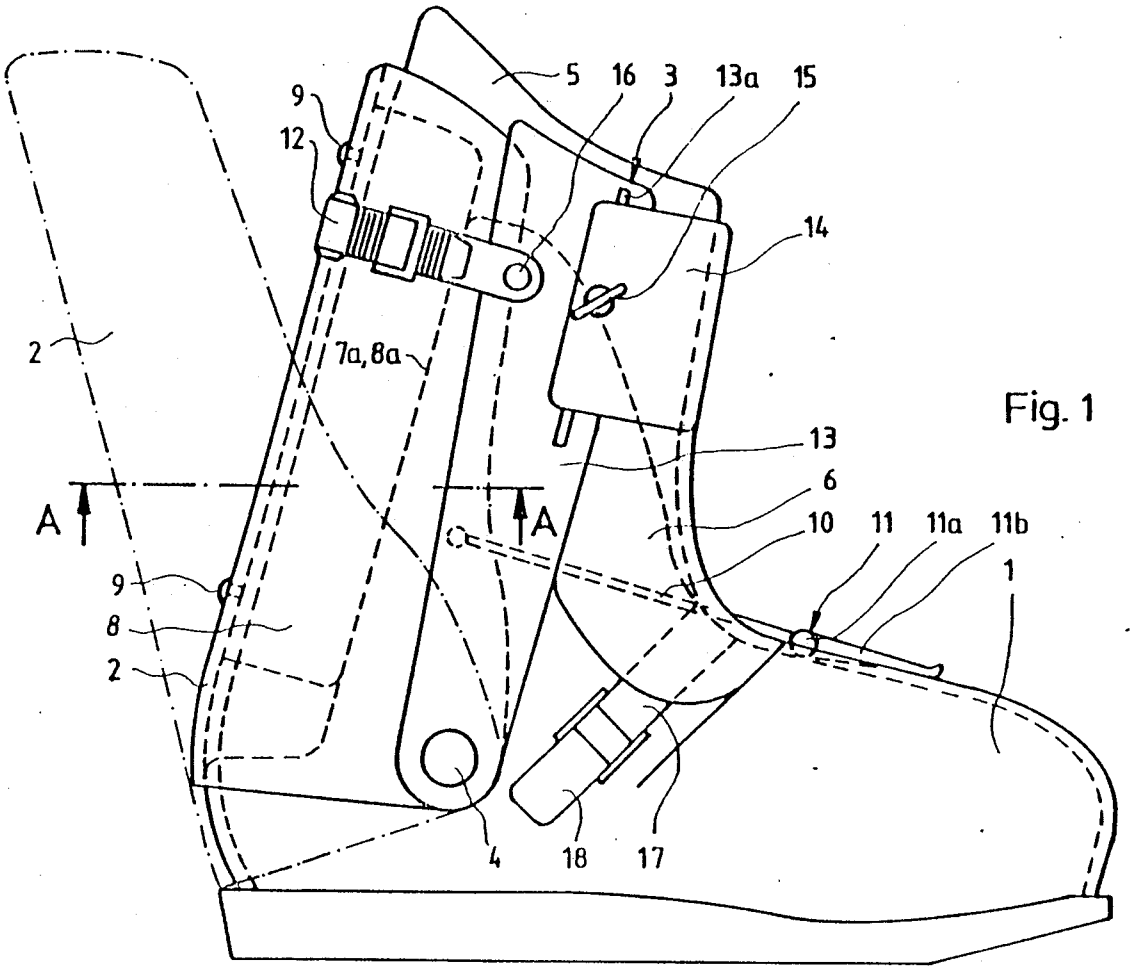
FIG. 1 shows a side view of a ski boot according to the invention.

The ski boot shown in FIG. 1 substantially comprises a lower shell 1, a rear portion 2 of the shaft and a front portion 3 of the shaft. The rear portion 2 of the shaft and front portion 3 of the shaft are connected with the lower shell 1 so as to be swivelable by means of an articulation 4. The lower shell 1, rear portion 2 of the shaft and front portion 3 of the shaft enclose an inner shoe 5. This inner shoe 5 is covered in the instep area by a foil 6 which communicates in turn with the front portion of the shaft and the lower shell 1.

Figure 2:
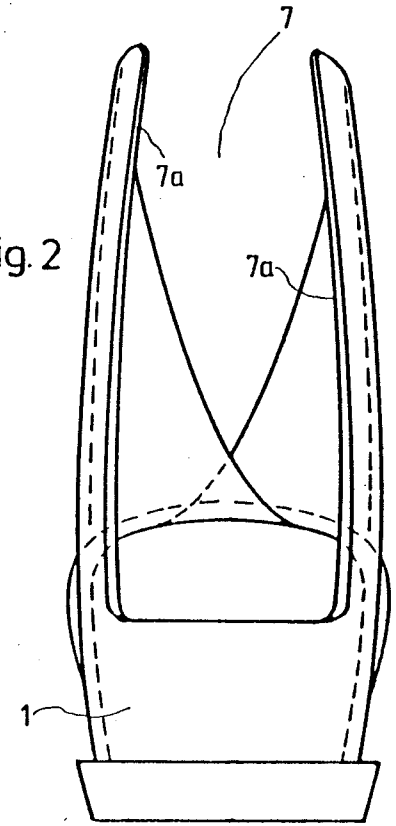
FIG. 2 shows a view of the lower shell of the ski boot corresponding to FIG. 1 from the rear.

As also shown in FIG. 2, the lower shell 1 is raised relatively far and partially encloses the back of the lower leg of the wearer. The thickness of these parts decreases slightly toward the top in an advantageous manner, so that these parts can be deformed in an elastic manner relatively easily. The area of the lower shell which projects partially into the instep area of the foot of the wearer is also relatively easily deformable. Due to the overlapping and the small thickness, there is no impediment to the freedom of movement of the wearer in the instep area.

The lower shell 1 comprises a cut out portion 7 which extends from the upper end almost to the base and is open toward the rear portion 2 of the shaft. The rear portion 2 of the shaft has an insert piece 8 at its inner side which complements the lower shell 1 by means of filling in the cut out portion 7 in its rear circumference when the rear portion 2 of the shaft is swiveled in. In this position, the flanks 7*a* of the cut out portion 7, which extend in the longitudinal direction of the shaft, and the flanks 8*a* of the insert piece 8, which extend in the same direction, cooperate as can also be seen particularly from FIG. 3.

The insert piece 8 is connected via the connecting means 9 with the rear portion 2 of the shaft so as to be detachable. These connecting means can be constructed e.g. as projections at the insert piece 8 which cooperate with corresponding recesses in the rear portion 2 of the shaft in the manner of a push button.

As can be seen in addition from FIG. 1, a clamping device comprising cable pull 10 and adjusting member 11, which works e.g. according to the ratchet principle, is provided for producing the inclination position of the rear portion 2 of the shaft. The cable pull 10 is fastened at the rear portion 2 of the shaft on the one hand and cooperates with the adjusting member 11 on the other hand, the adjusting member 11 comprising a roller 11*a* and an actuating lever 11*b*. The roller 11*a* can be activated by means of the actuating lever 11*b* so that the pull cable 10 is always sufficiently clamped according to the inclination position of the rear portion 2 of the shaft which is preselected by means of selecting the insert piece 8, and the rear portion 2 of the shaft is secured against swiveling out.

Figure 3:
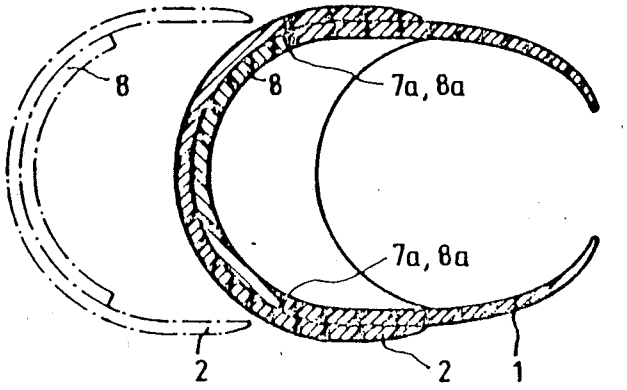
FIG. 3 shows the lower shell and the rear portion of the shaft of the ski boot corresponding to FIG. 1, in section corresponding to line A.

In addition to the swiveled in position of the rear portion 2 of the shaft, FIGS. 1 and 3 also suggestively show the swiveled out position of the rear portion 2 of the shaft, including insert piece 8 (FIG. 3). The rear portion 2 of the shaft occupies this position after the clamping device is disengaged, e.g. for the purpose of getting in and out of the boot or for exchanging the insert piece 8.

The front portion 3 of the shaft is connected with the rear portion 2 of the shaft by means of a connecting device 12 in the form of a clasp, known per se. The connecting device 12 can be arranged e.g. at the front portion 3 of the shaft and can loop loosely around the rear portion 2 of the shaft. If this is an adjustable connecting device 12, the clear width between the front portion 3 of the shaft and the rear portion 2 of the shaft can be varied.

The front portion 3 of the shaft comprises, in addition, a supporting part 13 and a sleeve 14, wherein the connecting device 12 is fastened at the supporting part 13 via an articulation 16. The sleeve 14, which is fastened so as to be swivelable, can be displaced along the supporting part 13 and fixed at the respective desired position. For this purpose, fastening means 15 are provided, which provide for the swivelability of the sleeve 14 on the one hand and for the fixing at the supporting part 13 on the other hand, e.g. via a slot 13*a*. The foil 6 is preferably constructed so as to be elastic in order to ensure the covering of the area between the lower shell 1 and the front portion 3 of the shaft, which area changes during the adjustment of the sleeve 14 and the swiveling of the supporting part 13. The foil can accordingly compensate for different vertical positions of the sleeve 14 and different inclinations of the supporting part 13, wherein a suitable fastening of the foil 6 at these parts is assumed.

Moreover, a heel pull consisting of a pull part 17 and clasp 18 is supported at the lower shell 1. The pull part 17 can be a flexible band which acts on the instep area of the foot of the wearer with the intermediary of the inner shoe 5 and elastically deformable areas of the lower shell 1 and accordingly ensures the hold in the lower shell 1. The clasp 18, which works according to principles which are known per se, is provided for clamping this pull part 17, its base preferably being adjustable for bridging the differences in length of the pull part 17.

Figure 4:
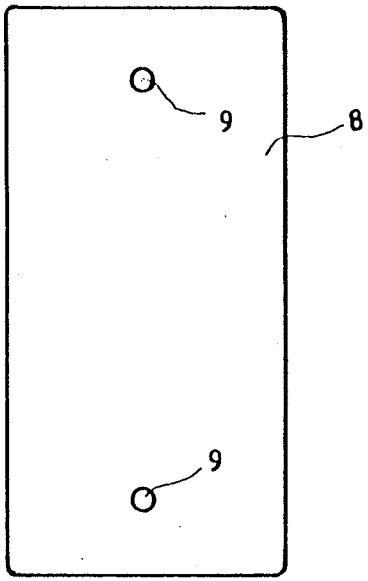
FIG. 4 shows the insert piece of the ski boot corresponding to FIG. 1.
Figure 5:
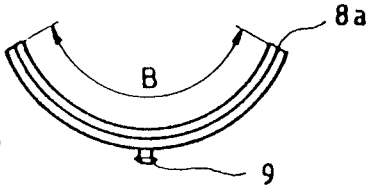
FIG. 5 shows a top view of the insert piece corresponding to FIG. 4.

The insert piece 8, which can be seen in detail from FIGS. 4 and 5, comprises a radian measure B of constant magnitude. The cut out portion 7 is accordingly completely filled in with respect to the circumference, so that there is practically no free space available between the flanks 8*a* of the insert piece 8 and the flanks 7*b* of the cut out portion 7 enabling an inclination of the shaft. Accordingly, a ski boot is formed whose shaft has a high degree of stiffness.

Figure 6:
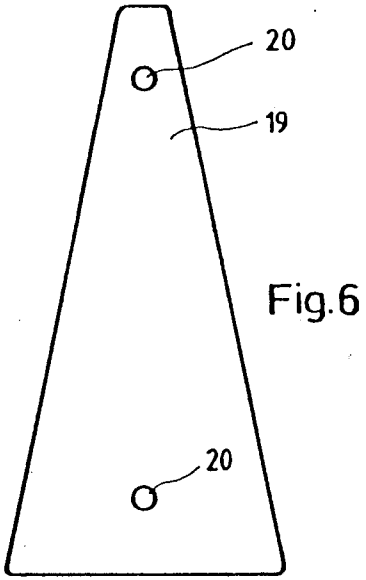
FIG. 6 shows a view of an insert piece with variable radian measure.
Figure 7:
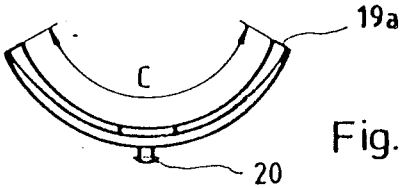
FIG. 7 shows a top view of the insert piece corresponding to FIG. 6.

In contrast, the insert piece 19 which can be seen from FIGS. 6 and 7 comprises a radian measure C of variable magnitude which decreases toward the upper end. Accordingly, an insert piece 19 is formed which is substantially wedge-shaped as viewed from the front and which provides considerable free space between the flanks 19*a* of the insert piece 19 and the flanks 7*a* of the cut out portion 7, so that a large space for shaping is made available for the corresponding part of the lower shell 1 of the ski boot. The shaft can accordingly be given a sharply inclined position, wherein a relatively soft shaft of the ski boot is provided in addition.

The thickness of the insert pieces 8, 19 preferably decreases toward the upper end in a manner corresponding to the part of the lower shell penetrated by the cut out portion 7. A perfect complementing of the cut out portion of the lower shell is accordingly formed without deviations in thickness which can result in disturbing transitions and accordingly unevenness in the inside of the ski boot.

I claim:

1. A ski boot, comprising:

a lower shell (1) which encloses at least a foot of a skier;

a longitudinal shaft having a rear portion (2) and a front portion (3), the shaft being arranged so as to enclose the skier's lower leg, the rear portion (2) of the shaft enclosing a back part of the lower leg and the front portion (3) enclosing a front part of the lower leg, the rear portion (2) and the front portion (3) of the shaft being connected with the lower shell (1) in an articulated manner, and the rear portion (2) and the lower shell (1) overlap at least partially;

a clamping device (10, 11) for producing an inclination position of the rear portion (2) of the shell; and stops provided at the lower shell (1) and at the rear portion (2) of the shaft so as to define the inclination position of the rear portion (2), the lower shell (1) having, in an area enclosing the lower leg, a cut out portion (7) which extends from an upper end of the shell shaft along a greater part of the shaft length and is open toward the rear portion (2) of the shafts, and an exchangeable insert piece (8, 19) at the rear portion (2) of the shaft which is assigned to the cut out portion (7), the stops being formed by flanks (76*a*, 8*a*19*a*) of the cut out portion (7) and of the insert piece (8, 19) which extend in the longitudinal direction of the shaft.

2. A ski boot according to claim 1, wherein the lower shell (1) can be deformed in an elastic manner in an area penetrated by the cut out portion (7) and surrounding the lower leg.

3. A ski boot according to claim 1, wherein the insert piece (8, 19) is arranged at inside of the rear portion (2) of the shaft, the insert piece (8, 19) being curved in an arc-shaped manner with an apex extending in the longitudinal direction of the shaft.

4. A ski boot according to claim 1, and further comprising detachable connecting means (9, 20) provided between the rear portion (2) of the shaft and the insert piece (8, 19).

5. A ski boot according to claim 1, comprising different insert pieces (8, 19) which differ from one another with respect to one of a magnitude of a constant radian measure (B) and a magnitude of a radian measure (C) which is variable along the insert piece (19).

6. A ski boot according to claim 1, wherein the front portion (3) of the shaft comprises a supporting part (13) arranged at the lower shell (1) in an articulated manner and a sleeve (14) swivelably connected with the supporting part so as to surround the front of the lower leg.

7. A ski boot according to claim 6, wherein the sleeve (14) is vertically adjustable relative to the supporting part (13) along the longitudinal direction of the shaft.

8. A ski boot according to claim 7, and further comprising fastening means (15) for connecting the sleeve (14) with the supporting part (13) at a predetermined height, the fastening means being provided between the sleeve (14) and supporting part (13).

9. A ski boot according to claim 6, and further comprising adjustable connecting means (12) for connecting the front portion (3) of the shaft comprising the sleeve (14) and supporting part (13) with the rear portion (2) of the shaft.

10. A ski boot according to claim 1, and further comprising a heel pull (17, 18) supported at the lower shell (1) so as to act on an instep area thereof.

* * * * *